US005156561A

United States Patent [19]

Kinoshita

[11] Patent Number: 5,156,561

[45] Date of Patent: Oct. 20, 1992

[54] TRIM AND TILT MECHANISM FOR USE WITH OUTBOARD ENGINE

[75] Inventor: Yutaka Kinoshita, Saitama, Japan

[73] Assignee: Kabushiki Kaisha Showa Seisakusho, Tokyo, Japan

[21] Appl. No.: 528,227

[22] Filed: May 24, 1990

[30] Foreign Application Priority Data

Jul. 3, 1990 [JP] Japan ..... 1-78551

[51] Int. Cl.[5] ..... B63H 21/26

[52] U.S. Cl. ..... 440/61; 91/55; 92/169.1

[58] Field of Search ..... 440/61; 92/169.1, 145; 91/55; 60/412, 473, 474, 475, 476, 477, 478, 479, 480, 588

[56] References Cited

U.S. PATENT DOCUMENTS

| | | | |
|---|---|---|---|
| 1,624,151 | 4/1927 | Shevlin | 60/474 |
| 2,148,231 | 2/1939 | Bowen | 60/588 |
| 2,160,075 | 5/1939 | La Brie | 60/588 |
| 3,136,128 | 6/1964 | Sater | 92/169.1 |
| 3,581,702 | 6/1971 | Moberg . | |
| 3,722,455 | 3/1973 | Carpenter . | |
| 4,391,592 | 7/1983 | Hundertmark . | |
| 4,565,528 | 1/1986 | Nakase . | |
| 4,605,375 | 8/1986 | Ferguson . | |
| 4,698,035 | 10/1987 | Fergason | 440/61 |
| 4,720,278 | 1/1988 | Taguchi et al. . | |
| 4,784,625 | 11/1988 | Nakahama | 440/61 |
| 4,786,263 | 11/1988 | Burmeister et al. . | |
| 4,957,457 | 9/1990 | Probst et al. . | |

FOREIGN PATENT DOCUMENTS 59-118593 7/1984 Japan .
60-169397 9/1985 Japan .

OTHER PUBLICATIONS

Abstract for Japanese Patent Publication No. 59-118593, dated Jul. 9, 1984, Applicant listed as Riyouichi Nakase.

*Primary Examiner*—Sherman D. Basinger
*Assistant Examiner*—Thomas J. Brahan
*Attorney, Agent, or Firm*—Merchant, Gould, Smith, Edell, Welter & Schmidt

[57] ABSTRACT

A trim and tilt mechanism angularly moves an outboard engine assembly into a desired trimmed position and also into a tilted position above the surface of the water. The outboard engine assembly is detachably mounted on the stern of a boat through a transom bracket and a swivel bracket coupled to the transom bracket for vertical angular movement relative to the transom bracket about a horizontal axis. The trim and tilt mechanism has a hydraulic cylinder unit including a casing which has one end pivotally coupled to the transom bracket and a piston rod which has one end pivotally coupled to the swivel bracket and which is reciprocally movable in the casing. Working oil to be supplied to and discharged from the casing is stored in a main tank and an auxiliary tank which are disposed in diametrically opposite relation to each other across the casing. The auxiliary tank is substantially cylindrical in shape and has a circular opening defined in its upper end and normally closed by an end cap. The center of the opening is displaced or offset from the axis of the auxiliary tank in a direction away from the casing.

3 Claims, 3 Drawing Sheets

TRIM AND TILT MECHANISM FOR USE WITH OUTBOARD ENGINE

BACKGROUND OF THE INVENTION

1. Field of the Invention

The present invention relates to a trim and tilt mechanism for angularly moving an outboard engine into a desired trimmed position and also into a tilted position above the surface of the water.

2. Description of the Relevant Art

Generally, an outboard engine is detachably mounted on the stern of a boat by a pair of transom brackets and a pair of swivel brackets pivotally coupled to the transom brackets. Outboard engines are often associated with trim and tilt mechanisms as disclosed in U.S. Pat. No. 3,581,702, for example. The disclosed trim and tilt mechanism angularly moves the outboard engine vertically so that the angle of the outboard engine in the water is adjusted with respect to the boat. In addition, the trim and tilt mechanism also serves to absorb shocks or impacts when the outboard engine happens to be hit by an object in the water. The trim and tilt mechanism has a hydraulic cylinder comprising a cylindrical casing and a piston rod reciprocally movable in the cylindrical casing. The piston rod has an upper free end pivotally coupled to the swivel brackets, and the casing has a lower end pivotally coupled to the transom brackets. When the hydraulic cylinder operates, the piston rod is reciprocally moved thereby to turn the outboard engine vertically about a horizontal axis.

The hydraulic cylinder is supplied with working oil which is stored in a tank. If the tank has a large storage capacity, then it reduces the installation space available for the hydraulic cylinder. One solution is to employ two relatively small oil tanks, and to attach one of the tanks, referred to as an auxiliary tank, to the cylindrical casing. This arrangement allows the trim and tilt mechanism to be designed with greater layout flexibility for use with outboard engines. It is advantageous if the auxiliary tank and the cylindrical casing are cast as a unitary structure. According to one casting process, a sand core is set in the cavity of a mold assembly, and after an auxiliary tank and a cylindrical casing are cast, the sand core is broken and the pieces of the broken sand core are removed. Unnecessary portions may be cut off the auxiliary tank and the cylindrical casing. The sand core pieces and the cut-off fragments or chips are taken out through a cap opening in the upper end of the auxiliary tank. If the cap opening is large enough, the sand core pieces and the cut-off fragments cap easily be removed therethrough. However, the wall which interconnects the casing and the auxiliary tank becomes so thin that its mechanical strength is not large enough.

SUMMARY OF THE INVENTION

It is an object of the present invention to provide a trim and tilt mechanism for use with an outboard engine assembly, the trim and tilt mechanism being of such a structure that sand core pieces and cut-off fragments or chips can easily be removed after the trim and tilt mechanism has been cast.

A trim and tilt mechanism for angularly moving an outboard engine assembly according to the present invention has a hydraulic cylinder unit which comprises a casing and a piston rod reciprocally movable in the casing. The piston rod has an upper end pivotally coupled to a swivel bracket of the outboard engine assembly, and the casing has a lower end pivotally coupled to a transom bracket mounted on the stern of a boat. When the piston rod is reciprocally moved, the outboard engine assembly is angularly moved vertically with respect to the boat about a horizontal axis. The outboard engine assembly is also angularly movable horizontally with respect to the swivel bracket about a vertical axis.

The trim and tilt mechanism has a main tank disposed on one side of the casing, for storing working oil to be supplied to and discharged from the casing, and a substantially cylindrical auxiliary tank integrally cast with the casing and positioned on another side of the casing which is diametrically opposite to the main tank. The auxiliary tank is vertically elongate and has an opening defined in its upper end and normally closed by an end cap In a preferred embodiment of the present invention, the center of the opening is displaced or offset from the axis of the auxiliary tank in a direction away from the casing. With this arrangement, the wall which interconnects the casing and the auxiliary tank is thick and sufficiently mechanically strong. The opening has a sufficient size or opening area for easy removal of sand core pieces and cut-off fragments from within the auxiliary tank after the casing and the auxiliary tank have been integrally cast.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
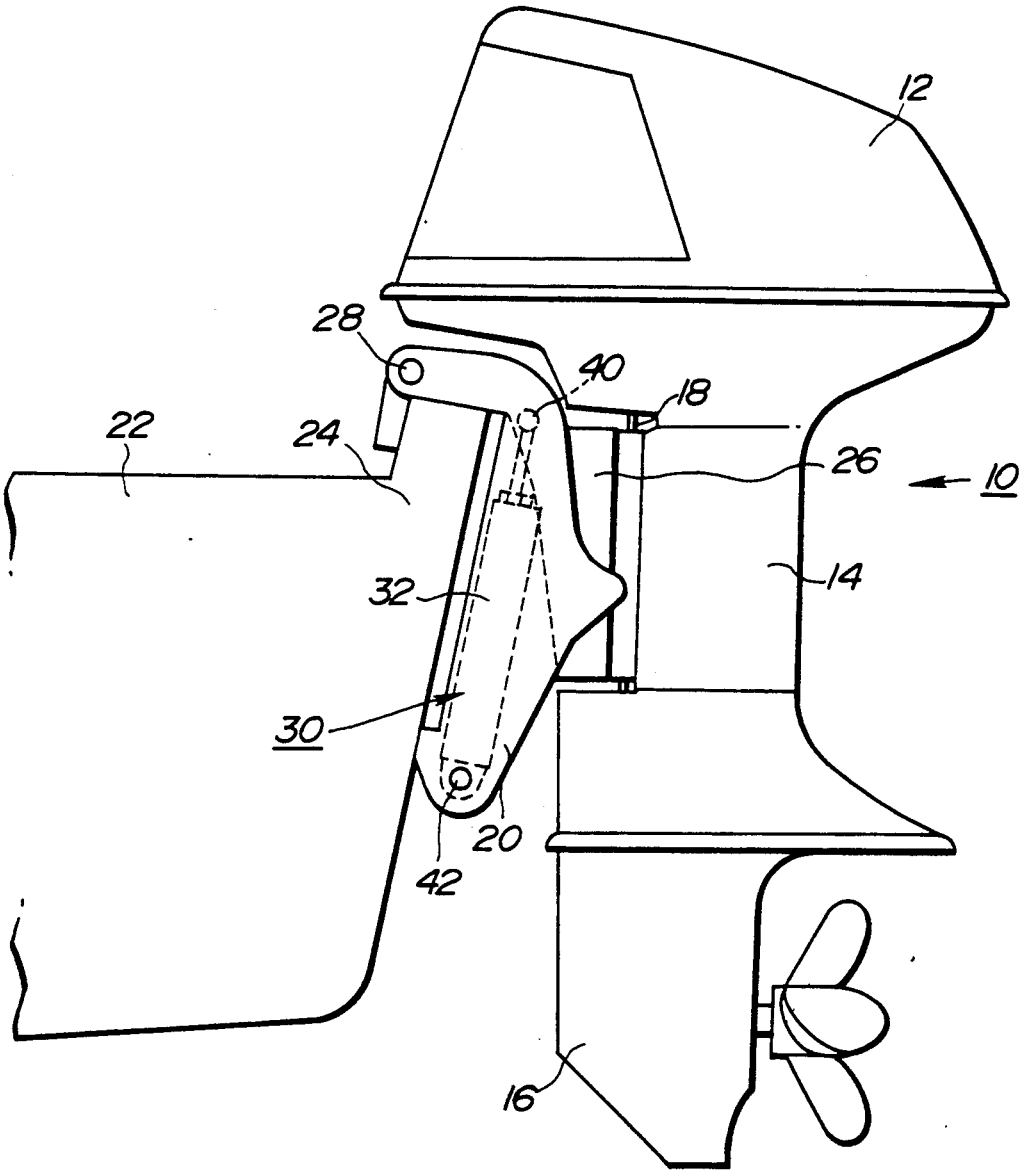
FIG. 1 is a side elevational view of an outboard engine associated with a trim and tilt mechanism according to the present invention.
Figure 2:
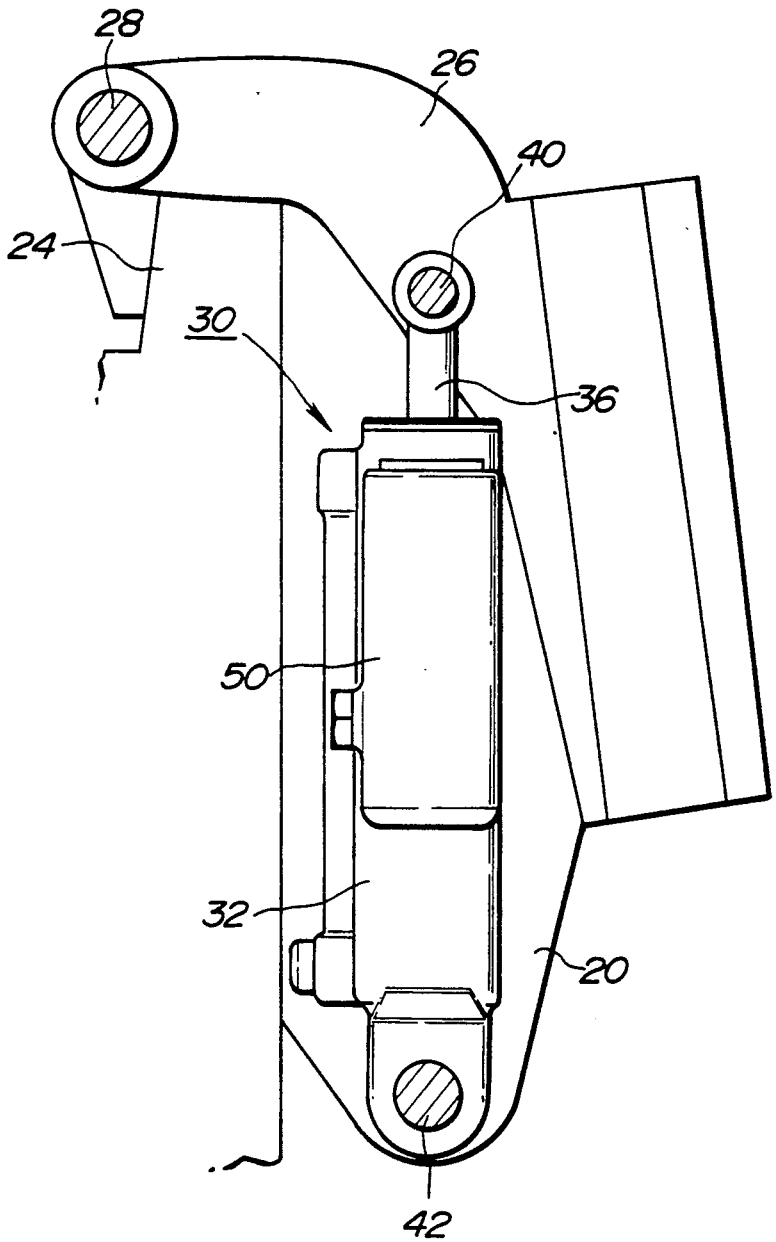
FIG. 2 is a an enlarged side elevational view of the trim and tilt mechanism shown in FIG. 1, with one transom bracket and one swivel bracket, which are positioned closer to the viewer, being omitted from illustration for an easier understanding of the structure of the trim and tilt mechanism.

As shown in FIG. 1, an outboard engine assembly 10 comprises an upper housing 12 accommodating an engine (not shown) such as an internal combustion engine, an intermediate housing 14 accommodating a drive shaft (not shown) coupled to the engine, and a lower housing 16 accommodating a gear mechanism (not shown) connected to the drive shaft. A vertical swivel pin 18 is supported on the intermediate housing 14 near a front edge thereof. The outboard engine assembly 10 also includes a pair of stern or transom brackets 20 mounted on the stern 24 of a small ship 22 such as a motorboat. The outboard engine assembly 10 is detachably mounted on the stern 24 by the transom brackets 20 and a pair of swivel brackets 26.

The transom brackets 20 are spaced apart from each other, and a pivot pin 28 extends substantially horizontally between the transom brackets 20. The swivel brackets 26 are of a substantially inverted L shape and have ends supported on the pivot pin 28. The swivel brackets 26 have on their rear ends a tubular member through which the swivel pin 18 extends. The outboard engine assembly 10 can therefore be angularly moved vertically about the pivot pin 28 and horizontally about the swivel pin 18.

Figure 3:
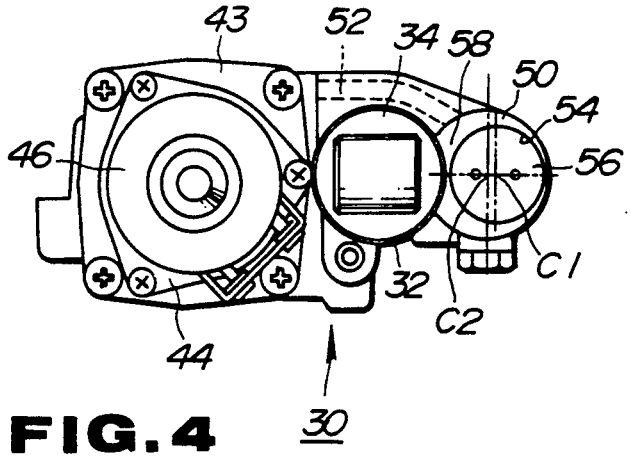
FIG. 3 is a front elevational view of the trim and tilt mechanism shown in FIG. 2.
Figure 4:
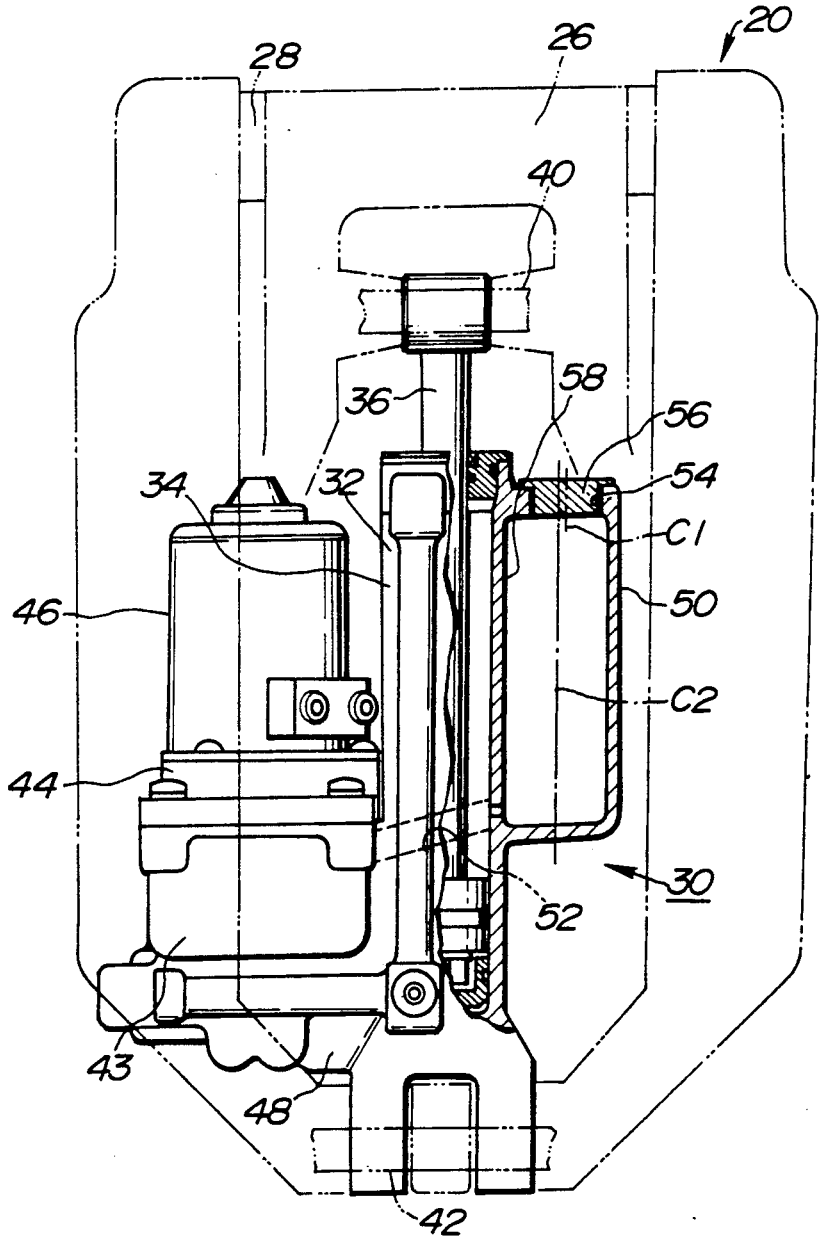
FIG. 4 is a plan view, partly in cross section, of the trim and tilt mechanism shown in FIG. 2.

As shown in FIGS. 3 and 4, a trim and tilt mechanism 30 associated with the outboard engine assembly 10 has a hydraulic cylinder unit 32 which comprises a casing 34 and a piston rod 36 reciprocally movably disposed in the casing 34. The piston rod 36 has an upper end pivotally coupled to a pivot pin 40 which extends substantially horizontally between the swivel brackets 26. The casing 34 has a lower end pivotally coupled to a pivot pin 42 which extends substantially horizontally between the lower ends of the transom brackets 20. When the hydraulic cylinder unit 32 operates, the piston rod 36 is extended or contracted to turn the outboard engine assembly 10 vertically about the pivot pin 28.

A main tank 43 for storing working oil to be supplied to and discharged from the hydraulic cylinder unit 32 is disposed on one side (lefthand side in FIG. 4) of the casing 34. A pump unit 44 which is drivable by a motor 46 is mounted on the upper surface of the main tank 43. A spool valve 48 which is disclosed below the main tank 43 controls the flow of working oil which is supplied to the hydraulic cylinder unit 32 by the pump unit 44. A substantially cylindrical auxiliary tank 50, which also stores working oil to be supplied to and discharged from the hydraulic cylinder unit 32, is integrally cast with the casing 34 on a side (righthand side in FIG. 4) which is diametrically opposite to the main tank 43. The auxiliary tank 50 communicates with the main tank 43 through an inclined joint pipe 52.

The auxiliary tank 50 is vertically elongate and has a substantially circular opening 54 defined in its upper end, and the opening is normally closed off by an end cap 56. In the illustrated embodiment, the opening 54 has a center C1 which is displaced or offset from the axis C2 of the auxiliary tank 50 radially outwardly along a line interconnecting the center C1 and the axis C2 and in a direction away from the casing 34. With this arrangement, a wall 58, which serves as both a peripheral wall of the casing 34 and a peripheral wall of the auxiliary tank 50, maintains a desired thickness, and hence has a desired mechanical strength. The opening 54 in the upper end of the auxiliary tank 50 is of a sufficient size or opening area to allow sand core pieces and cutoff fragments or chips to be easily removed from the auxiliary tank 50 after the casing 34 and the auxiliary tank 50 have been cast together.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

I claim:

1. A trim and tilt mechanism for angularly moving an outboard engine assembly which is detachably mounted on the stern of a boat through a first bracket and a second bracket coupled to the first bracket for vertical angular movement relative to the first bracket about a horizontal axis, said trim and tilt mechanism comprising:

a hydraulic cylinder unit including a substantially cylindrical casing which has one end adapted to be pivotally coupled to the first bracket and a piston rod which has one end adapted to be pivotally coupled to the second bracket and which is reciprocally movable in said casing;

a main tank for storing working oil to be supplied to and discharged from said hydraulic cylinder unit; and a substantially cylindrical auxiliary tank for storing working oil to be supplied to and discharged from said hydraulic cylinder unit, said auxiliary tank having a substantially circular opening defined in an upper end thereof;

said auxiliary tank being integrally cast with said casing, said opening having a center displaced from the axis of said auxiliary tank along a line interconnecting said center and said axis and in a direction away from said casing.

2. A trim and tilt mechanism according to claim 1, wherein said main tank and said auxiliary tank are positioned in diametrically opposite relation to each other across said casing.

3. In an outboard marine propulsion device comprising a transom bracket adapted to be attached to a boat transom and a swivel bracket connected to said transom bracket for vertical swinging movement relative to said transom bracket about a horizontal axis, the improvement comprising a trim and tilt mechanism including:

a hydraulic cylinder unit including a substantially cylindrical casing which has one end pivotally coupled to the transom bracket and a piston rod which has one end pivotally coupled to the swivel bracket and which is reciprocally movable in said casing;

a main tank for storing working oil to be supplied to and discharged from said hydraulic cylinder unit; and a substantially cylindrical auxiliary tank for storing working oil to be supplied to and discharged from said hydraulic cylinder unit, said auxiliary tank having an opening defined in an upper end thereof;

said auxiliary tank being integrally cast with said casing, said opening having a center offset from the axis of said auxiliary tank in a direction away from said casing.

* * * * *

UNITED STATES PATENT AND TRADEMARK OFFICE

CERTIFICATE OF CORRECTION

PATENT NO. : 5,156,561

DATED : October 20, 1992

INVENTOR(S) : Kinoshita

It is certified that error appears in the above-identified patent and that said Letters Patent is hereby corrected as shown below:

Cover page, [30] Foreign Application Priority data; "July 3, 1990" should read --July 3, 1989--.

Column 3, line 36; insert --54-- after the word "opening".

Signed and Sealed this

Twenty-third Day of November, 1993

*Attest:*

Bruce Lehman

BRUCE LEHMAN

*Attesting Officer*

*Commissioner of Patents and Trademarks*